United States Patent [19]

Lancaster, III

[11] Patent Number: 4,497,159

[45] Date of Patent: Feb. 5, 1985

[54] FRICTION DRIVE STRETCH WRAPPING APPARATUS

[75] Inventor: Patrick R. Lancaster, III, Louisville, Ky.

[73] Assignee: Lantech, Inc., Louisville, Ky.

[21] Appl. No.: 344,870

[22] Filed: Feb. 1, 1982

[51] Int. Cl.[3] ..... B65B 11/04; B65B 53/00

[52] U.S. Cl. ..... 53/556; 53/211; 53/399; 53/587

[58] Field of Search ..... 53/556, 587, 211, 399, 53/441, 465; 226/195; 264/288.4; 26/28, 71, 245; 156/494, 495

[56] References Cited

U.S. PATENT DOCUMENTS

| | | | |
|---|---|---|---|
| 3,779,441 | 12/1973 | Policella | 226/195 X |
| 4,248,031 | 2/1981 | Del Pozo, Jr. | 53/556 |
| 4,302,920 | 12/1981 | Lancaster et al. | 53/556 X |
| 4,317,322 | 3/1982 | Lancaster et al. | 53/441 X |
| 4,371,417 | 2/1983 | Frick et al. | 156/495 |
| 4,387,552 | 6/1983 | Lancaster et al. | 53/556 |
| 4,413,463 | 11/1983 | Lancaster | 53/441 |

*Primary Examiner*—Robert L. Spruill
*Assistant Examiner*—Donald R. Studebaker
*Attorney, Agent, or Firm*—Gipple & Hale

[57] ABSTRACT

An apparatus for applying stretchable plastic film to loads for containment of the loads using two frictionally connected rollers which are held together and driven by the film web at different speeds to elongate the plastic film beyond its yield point. After the elongated film has been stretched, it is wrapped around a rotating load. The rollers are cammed apart during the beginning of the wrap so that relatively untensioned film is wrapped around the load at the beginning of the wrap. The cam force is then released and the rollers are pulled together in frictional engagement by the film web being pulled off of the film roll to stretch the film web.

15 Claims, 5 Drawing Figures

FRICTION DRIVE STRETCH WRAPPING APPARATUS

BACKGROUND OF THE INVENTION

The present invention generally relates to packaging and more particularly to a simple apparatus for wrapping a load having a plurality of components to contain the load in a web of stretched film as a unitary package. This simplified apparatus can be used on low value stretch wrapping machines.

Case packing or boxing is a common way of shipping multiple unit products. The multiple unit products are generally stacked in a corrugated box or are wrapped with kraft paper with the ends of the kraft paper being glued or taped. Another way of shipping such products is by putting a sleeve or covering of heat shrinkable film around the products and shrinking the sleeve to form a unitized package. The use of heat shrinkable film is described in U.S. Pat. Nos. 3,793,798; 3,626,654; 3,590,549 and 3,514,920.

The most common method of wrapping loads currently being used is with rotary stretch wrapping machines. These rotary machines are commonly referred to as spiral or full-web machines, and can operate with the load rotating to pull stretched film web around it. Alternatively, the load can be stationary and stretched film wrapped around the load with a rotating film dispenser.

A typical state-of-the-art full-web apparatus is disclosed in U.S. Pat. No. 3,867,806. This patent discloses the use of relatively untensioned film at the beginning of a wrap.

The use of spiral wrapping machinery is well known in the art and representative machines are typified by U.S. Pat. Nos. 3,003,297; 3,788,199; 3,683,425 and 4,136,501.

The film stretching means on all low volume currently marketed pallet stretch wrapping devices employ either direct or indirect friction to restrict the film as it is being wound onto the load during the wrapping process. The restriction is either applied to the roll of film itself (direct friction) or applied to the film after it is unwound from the film roll (indirect friction). The pallet and load serve as the winding mandrel providing all of the pulling force required to elongate the film.

The earliest type of film stretch wrapper utilized a direct friction device in the form of a brake that is connected to the film roll through the core. The torque from the frictional brake device acted on the center of the film roll and as the roll changed diameter, the voltage to the brake was altered, either by the operator or automatically by a sensing device. A later film roll brake device, illustrated by U.S. Pat. No. 4,077,129, utilizes a frictional brake attached to a shaft with a roller which is pressed against the freely mounted film roll. The film roll brake eliminates the need to change the brake force during the consumption of the film roll.

Various prior art indirect friction film stretching devices have been employed to restrict the film as it is wound onto the pallet during the wrapping process. One of these devices, commonly referred to as an "S" type roller device, utilized an idle roller followed by a braked roller over which the film is threaded prior to wrapping the load. The function of the two rollers is to align the film for maximum contact with the braked roller. Another indirect friction device having fixed bars was marketed by a company known as Radient Engineering Corporation under the trade name POS-A-TENSIONER and has been subsequently marketed by the Kaufman Company under the trade name TNT. This device has a series of fixed, non-rotating bars positioned adjacent to the film roll. The film web is threaded around the bars whose relative angles can be changed for ultimate tensioning. As the film web is attached to the pallet, it is drawn across the bars and the friction between the film and the smooth surface of the bars provides a restriction causing the film to stretch. This device uses multiple bars with the film web stretching incrementally between each bar. Neck-down of the film web increases between each bar and the load bears the force. As the load rotates, the wrap angle changes from the last bar so that the wrapping force greatly varies depending on the relative angles. The frictional restraint is determined by the vector of the film web on each bar. Thus, the device is very sensitive to the force placed on the unwind roll and the force increases as the roll size decreases adding additional force on the system. Furthermore, there must be some friction placed on the supply roll to prevent backlash. While this device solves, to some degree, the irregularities of the brake and the hostility of the film roll, it can only apply limited stretch to the load and does not handle different film compositions with any degree of standardization.

Another stretch wrapper device was introduced by the Anderson Company at the PMMI Show in Chicago in 1978. This device interconnected the turntable drive motor with a pair of nip rollers immediately downstream from the film unwind roll. The nip rollers were synchronously driven with the turntable rotation through a variable transmission which could be increased or decreased in speed relative to the turntable rotation speed. Thus, the stretch on the film was affected between the constant speed nip rollers and the pallet turning. It is not known if this machine was ever commercialized, principally because of its inability to achieve satisfactory stretch over the load corners due to its failure to respond to the speed change that these corners represented. The pallet, as the film accumulating mandrel, provided the total force that was required to stretch the film from the driven nip rollers with all of the stretch occurring after the passage of the film from the nip rollers to the pallet.

The aforementioned stretching devices do not maintain a consistent force in stretching the film web. These brake devices are subject to variation due to their physical construction and their sensitivity to speed change caused by passage of corners of the load and the resultant sudden speed-up and slow-down of the film drawn from the feed roll.

The elasticity of stretched plastic film holds the products of the load under more tension than either shrink wrap or kraft wrap, particularly with products which settle when packaged. The effectiveness of stretched plastic film in holding a load together is a function of the containment or stretch force being placed on the load and the ultimate strength of the total lavered film wrap. These two functions are determined by the modulus of hardness of the film after stretch has taken place and the ultimate strength of the film after application. Containment force is currently achieved by maximizing elongation until just below a critical point where rupture of the film occurs. Virtually all stretch films on the market today, including products of Mobil Chemical Company (Mobil-X, Mobil-C and Mobil-H), Borden Resinite Division PS-26, Consolidated Thermoplastics, Presto, PPD and others, are consistently stretched less than thirty percent in most commercial applications despite manufacturer's laboratory rated capacity in excess of 300 percent in most cases.

The problem of obtaining less stretch on commercial wrapping than that available under laboratory conditions centers on several facts. A square or rectangular pallet which is typically positioned off of its center of rotation is used as the wind up mandrel for the purpose of stretching film. A typical 40"×48" pallet positioned 3 to 4 inches off of its center of rotation will experience a speed change of up to sixty percent within one quarter revolution of the turntable.

In addition to the off centering problem, most pallet loads are irregular in shape with vertical profiles which produce a significant puncture hazard to highly stretched film being wound around them. Further, some unit loads are very susceptible to crushing forces of the stretched film. Because of pallet load changes and inconsistencies within the film roll, the operator typically continues to reduce the tension settings until there are no failures. Thus, the inconsistencies of films, stretching devices, and pallet loads produce an environment where very few stretch films are actually stretched to their optimum yield.

The major problems with current stretch technology are that stretch is produced by frictional force devices to restrict the film travel between two relatively hostile bodies. On the one hand the film roll is subject to edge wandering and feathering, while on the other hand the rotating pallet with its irregular edges and rapidly changing wind-up speed severly limits the level of elongation achieved. The ultimate holding forces of the film cannot be brought to bear on the load because the film cannot be stretched enough. Even if the film could be stretched enough, the high wrapping forces can disrupt or crush many unit loads. The use of high modulus films, such as oriented films, does not produce the yield benefits of the current invention, since these higher modulus films would have to be significantly stretched in order to achieve the rubberband effect and moldability required for irregular loads.

It therefore can be understood, since the pallet provides the forces for stretching the film, that stretch percentages achieved on the pallet and the stretch force achieved are intertwined in all prior art devices. As previously indicated, high stretch percentages are required to achieve the benefits of high yield, but the high stretch forces incurred at these high stretched percentages cause premature film rupture and potential crushing of the load.

A stretch wrapping device known under the trademark "ROLLER STRETCH" is currently manufactured by Lantech, Inc., which utilizes the film web to drive the apparatus. This device, which is more fully described in U.S. Pat. No. 4,302,920, addresses several of the aforementioned problems. Since the film is prestretched between the rollers, which is due to the mechanical advantage between the film driven rollers, it isolates the stretching action from between the film roll and the pallet. This device provides a consistent level of stretch, and more importantly responds to force and speed changes of the pallet without complex feedback controls currently required on other pre-stretch devices.

Balance is achieved when elongation between the rollers ($E_1$) is equal to elongation on the load ($E_2$). The relatively higher forces between the closely spaced rollers are overcome by the lower force required to drive the device by the film between the roll and the load. The stress/strain curve experienced between closely spaced rollers is substantially higher than the curve where film is allowed to expend the pulling force. Thus, the film to the load effects this higher force between the rollers aided by the mechanical advantage of the differential pulley relationship of the gear connected rollers. At balance point the elongation on the load ($E_2$) equals elongation between the rollers ($E_1$) and the mechanical advantage represents the difference between the forces corrected for friction. Balance is achieved on most films of 120 percent or less elongation between the rollers.

It is therefore apparent that there exists a need for an inexpensive pallet load wrapping apparatus which can utilize the benefits taught by U.S. Pat. No. 4,302,920.

SUMMARY OF THE INVENTION

An apparatus for applying stretched plastic film to pallet loads for containment of the loads using a prestretching mechanism in the form of two frictionally engaged rollers driven by the film web at different speeds to elongate the plastic film between the engaged rollers and wrap the elongated film around a rotating pallet. A cam device is placed on the apparatus which forces the rollers apart against the force of the film web holding the rollers together so that an initial portion of the wrap can be placed on the load in a substantially unstretched condition.

The apparatus pre-stretches the film before wrapping so that the film may be elongated before it is wrapped around the load holding the load under compressive forces. Achieving the higher film stretch levels with the invention allows fewer revolutions of film with equivalent holding power and less film by weight for each revolution of wrap.

Thus, the present invention allows at least double the practical level of elongation currently experienced with prior art "brake" systems, giving higher containment forces and/or lower film costs to the end user.

The invention also allows for more precise control of elongation allowing the user to get maximum cost efficiency from the new high yield films, along with higher film strength or modulus achieved at higher levels of elongation. The higher levels of elongation which are achieved on the film can be achieved without disruptive or crushing forces on the load because of the mechanical advantage experienced between the pulling force to the pallet and the force between the rollers.

The novel construction in the invention provides for isolation of the film roll from stretch forces by using the film web pulled by the pallet to hold the rollers in frictional engagement. The use of this simplified construction eliminates the use of friction brakes and the problems of those brakes such as speed variation, breakaway from stop position, temperature variation, wear, and operator control meddling, as well as eliminating direct mechanical connection of the rollers through gears or belts.

The use of the film web as the drive, as opposed to motor driven devices, also eliminates the need for compensation devices for corner passages, length/width variation or in turntable speed, as well as eliminating tension compensation devices.

It can thus be seen that the present invention provides a unique apparatus in that two rollers are frictionally engaged and driven by film from the rotating load causing the film to be stretched before it is applied to the load. The present invention essentially eliminates the neck-down of the film web normally experienced at high elongation rates by limiting the stretching action to a minimum distance between the rollers and avoiding secondary stretch between the second roller and the load. The driving force is obtained by placing the rollers closely together and rotating them in the opposite direction.

Although the invention is set forth in the claims, the invention itself and the method by which it is made and used may be better understood by referring to the following description taken in connection with the accompanying drawings forming a part hereof, in which like reference numerals refer to like parts throughout the several views.

DETAILED DESCRIPTION OF THE DRAWINGS

Figure 2:
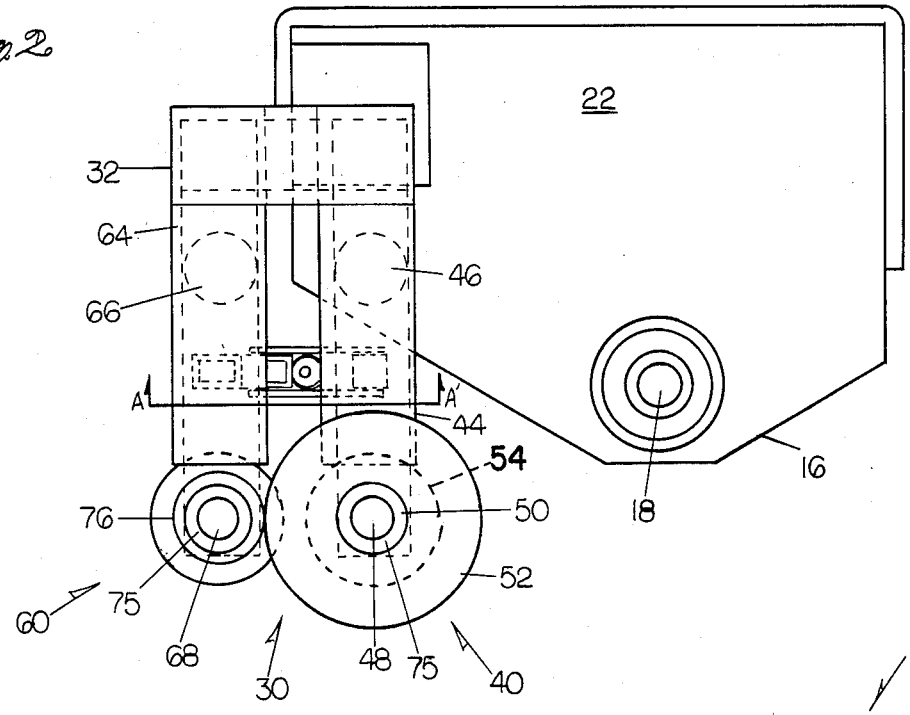
FIG. 2 discloses an enlarged top plan view of the carriage assembly of the invention as shown in FIG. 1.

The inventive wrapping apparatus 10 is shown in FIGS. 1-5 with the preferred embodiment and best mode of the invention being shown in these figures. The operation and construction of the apparatus and its respective component parts are discussed in the following description.

The film web friction drive stretch wrapping apparatus 10 comprises an upright frame 12 sitting on a base 14. A carriage 16 is moveably mounted on the frame 12 as is well-known in the art, and is driven by rack and pinion, chain, or other suitable drive means which are also well-known in the art. Stretch wrapping apparatus having such carriage and drives are typified by commercial machine Model Nos. SVS/80, SVSM/80, STVS/80, STVSM/80 and SAHS/80 manufactured by Lantech, Inc. A film unwind stand 18 which is also well-known in the art is mounted on the carriage 16. The stand 18 is constructed to allow contact to the unwind roll to allow a smooth film web 21 to unwind from the roll 20 mounted on stand 18 without backlash to a pre-stretch roller assembly 30. The roller assembly 30 is constructed with a pivotal frame 32 comprising a drive roller sub-assembly 40 and a driven roller sub-assembly 60.

The pivotal frame 32 is mounted to a bottom pivot member 34 mounted to the base 22 of the carriage body 17 and an upper pivot member 36 mounted to an "L" shaped bracket 38 secured to a side 24 of the carriage body by bolts 39. The drive roller sub-assembly 40 comprises a base arm member 42 pivotally mounted on pivot member 34 and sandwiched between thrust washers 43 and a top arm member 44 pivotally mounted to the upper pivot member 36 which is also sandwiched between thrust washers 43. A collar 45 is mounted to the top of upper pivot member 36. A tubular support brace 46 shown in phantom in FIG. 2 is secured to and connects the base arm member 42 and top arm member 44. A roller shaft 48 is rotatably mounted in bushings 50 which are respectively mounted to the base arm member 42 and top arm member 44. Shaft 48 extends above the top arm member 44 and may be splined at its end to seat an upper drive roller 52. The upper drive roller 52 is, however, preferably constructed of a two layer molded plastic construction similar to the upper driven roller 76 shown in FIG. 3. The inner layer 75 of driven roller 76 or drive roller 52 is constructed of 90 durometer polyurethane and projects downward below the outer circumference of the outer layer 175 of 40–45 durometer polyurethane to form a collar 53. The collar 53 has two axially aligned holes cut therein which are adapted to be aligned with a hole drilled in the shaft, so that a pin or bolt 55 can be placed there through fixing the drive roller 52 and driven roller 76 on shafts 48 and 68 respectively. A lower film engaging roller member 54, as shown in phantom in FIG. 2, is fixably mounted on shaft 48 between the base arm member 42 and upper arm member 44 and rotates or drives shaft 48 and the upper drive roller 52 as the film web 21 is pulled around it.

The driven roller arm sub-assembly 60 comprises a lower "L" shaped base arm member 62 pivotally mounted on pivot member 34 and an "L" shaped upper arm member 64 pivotally mounted to the upper pivot member 36. A tubular support brace 66 is secured to and connects base or lower arm member 62 and upper arm member 44. Rotatable shaft 68 is rotatably mounted to the bushings 70 and 72 which are respectively mounted to the base arm member 62 and a three hole flange member 73 of a standard construction having self-aligning ball bearings. A film engaging roller 74 is fixably mounted on shaft 68 between base arm member 62 and upper arm member 64. Shaft 68 extends above the upper arm member 64 and may alternatively be splined at its end to seat a upper driven roller 76. In the preferred embodiment, both the upper drive roller 52 and upper driven roller 76 are constructed of a high impact wear-resistant material having a high coefficient of friction. The rollers are preferably constructed of polyurethane or other suitable plastic and are smoothly faced for maximum frictional contact.

The upper drive roller 52 is of a diameter greater than the upper driven roller's diameter of a ratio desired to give the desired degree of stretch on the film web. The preferred ratio ranges from 3:2 to 3:1.

The pivotal frame 32 is provided with a cam assembly 80 comprising a cam following assembly 82 mounted to lower arm member 42 and cam member 84 mounted to lower arm member 62. The cam assembly 80 operates to drive the roller sub-assemblies 40 and 60 apart at the bottom of the spiral wrap. Cam member 84 comprises a rectangular steel member 86 having a planar inclined surface 88 on which the cam follower assembly 82 travels. The cam follower 82 comprises a bracket 90 secured to the top surface of the base arm member 42 and spaced plates 92 having their rear ends pivotally mounted in bracket 90 by pin 94. The forward ends 96 of the two spaced plates 92 are bevelled and drilled to hold a roll pin 98 upon which is mounted a cam roller 100. The cam roller 100 is preferably a Magill cam roller and the roll pin 98 is held in the inner race of the cam roller. The roller 100 is aligned with the inclined surface 88 of the cam member 86 and travels along the inclined surface of the cam member. A tubing or sleeve 102 is vertically secured to both of the plates 92 by welding and holds an adjustable pin assembly. The pin assembly comprises a washer or collar 104 welded to sleeve 102 in which a cam rod 106 is slideably mounted. A spring 108 is positioned in the sleeve 102 and has one end secured to the bottom of collar 104 and its other end secured to a collar 110 which is sized to freely slide inside of sleeve 102. The collar or guide 110 is secured to cam rod 106 which extends below arms 42 and 62. The cam rod 106, when it hits cam stop 15, will slide up the sleeve 102 and compress the spring upward driving roller 100 along inclined cam surface 88.

In operation, as the carriage is driven downward towards the end of the wrap at the bottom of the load, the lower section of cam rod 106 engages the top of stop 15 which can be of any suitable shape driving the roller 100 upward against the inclined surface 88 of cam 86 forcing both roller sub-assemblies 40 and 60 apart. This camming action operates against the force of the film web pulled by the rotating load which naturally tends to pull the driver and driven roller sub-assemblies together so that they frictionally engage each other. As the carriage moves upward, the upward pressure on the cam assembly 80 is decreased and the roller 100 travels down the inclined cam. Spring 108 drives cam rod 106 downward and the cam surface is no longer in engagement so that the roller surfaces are frictionally engaged by the film web pulling on the roller surfaces, thus pulling the drive and driven rollers into fractional engagement.

Figure 1:
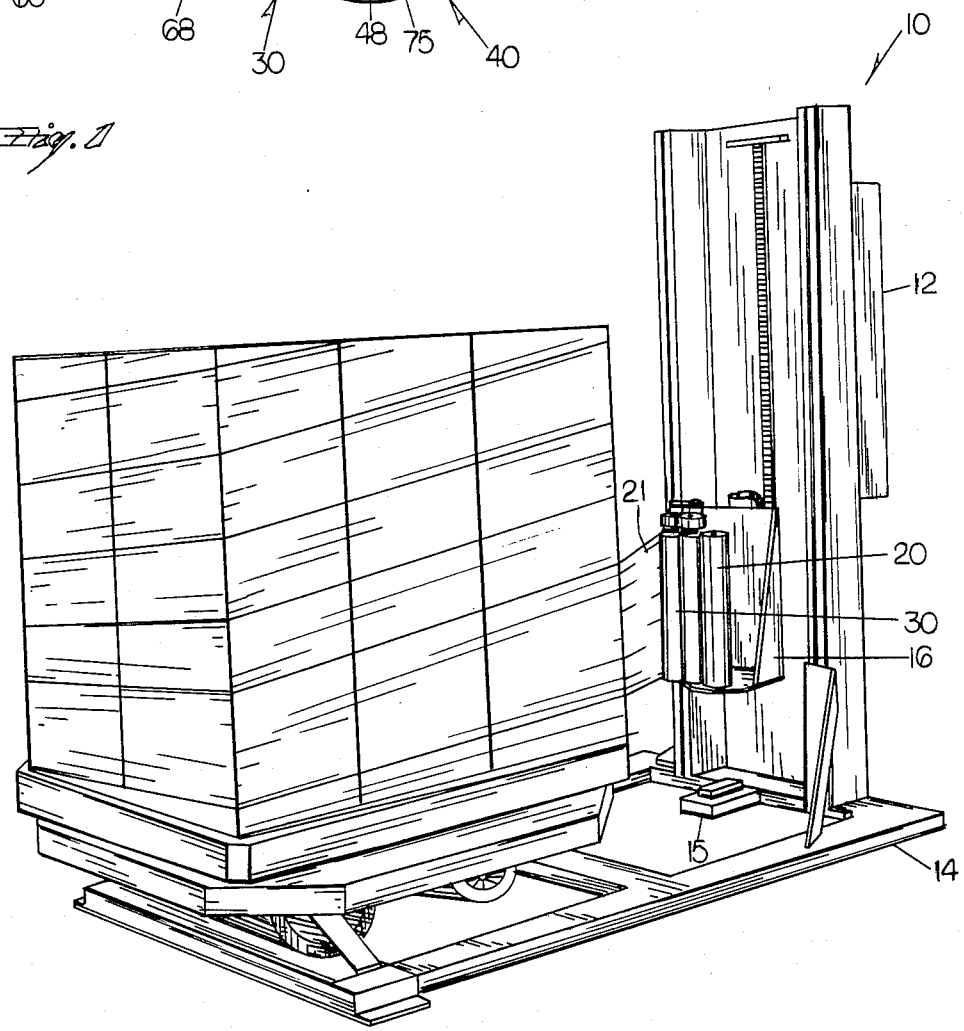
FIG. 1 discloses a perspective view of the invention.
Figure 3:
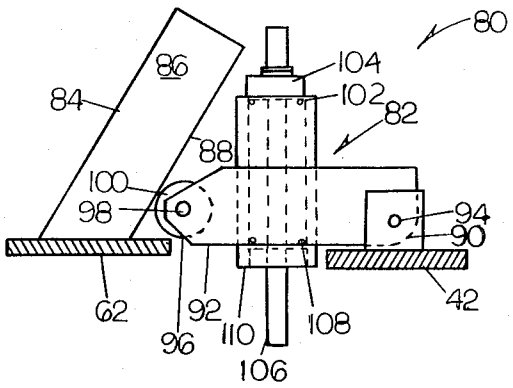
FIG. 3 is an enlarged side elevational view of the carriage shown in FIG. 2, showing the roller assemblies.
Figure 4:
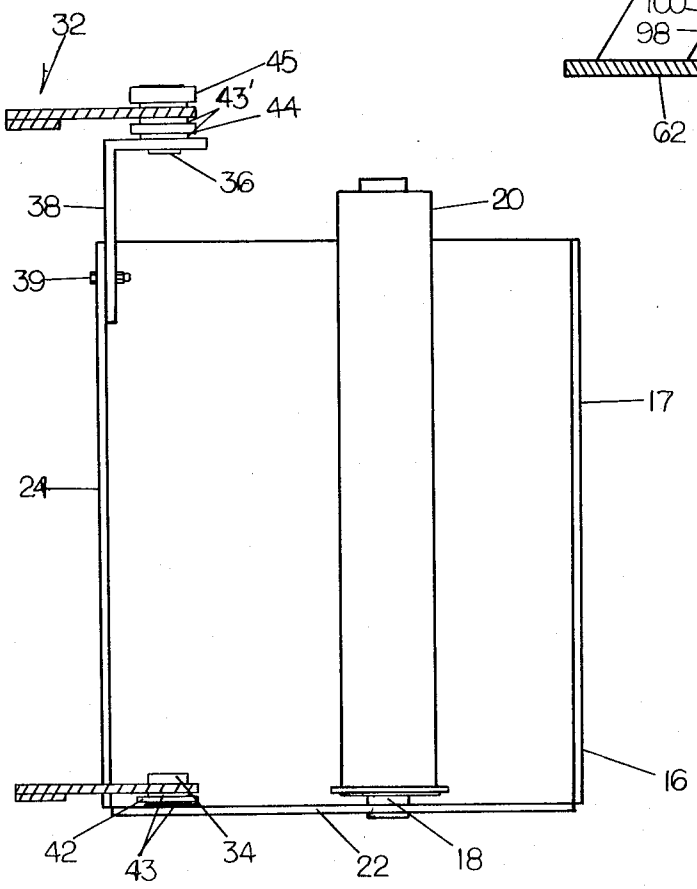
FIG. 4 is an enlarged side elevational view of the carriage assembly shown in FIG. 2 with the film roll and roller assemblies removed.
Figure 5:
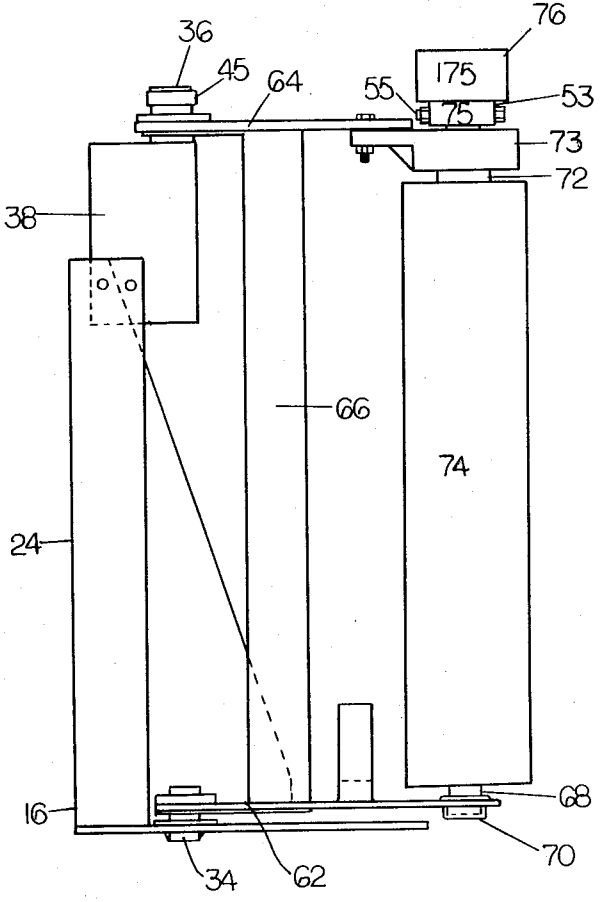
FIG. 5 discloses an enlarged side elevational view of the cam mechanism of the invention shown in FIG. 2.

As is seen in FIG. 1, the rollers are frictionally engaged so that the film web will drive the downstream or driven roller at a faster rate than the upstream or drive roller causing the film to be stretched between the two rollers to the desired amount of pre-stretch. This amount of pre-stretch can be changed by varying the ratio between the drive and driven rollers with the diameter ranging from 3:2 to 3:1.

It should be noted that various components of the wrapping and sealing apparatus can be interchangeable without departing from the scope of the invention. In the foregoing description, the invention has been described with reference to a particular preferred embodiment, although it is to be understood that the specific details shown are merely illustrative, and the invention may be carried out in other ways without departing from the true spirit and scope of the following claims.

What is claimed is:

1. An apparatus for making a unitary load using a single web of stretchable plastic material to form an overwrap holding the load under a compressive force comprising a frame, a dispenser means, said dispenser means being adapted to hold and dispense a roll of stretchable material, a means for supporting a load, a means for providing relative rotation between the load and dispenser means to pull said material off of said dispenser means, elongation means connected to said dispenser means adapted to receive stretchable material pulled from said dispenser means, said elongation means comprising a downstream roller and an upstream roller closely spaced apart and interconnected by frictionally engageable members, said rollers being driven by engagement of the moving material pulled from the dispenser means by relative rotation of the load and dispenser means so that said frictionally engageable members are driven causing the downstream roller to transport the plastic material faster than said upstream roller elongating the material, thereby causing stretched material to be placed around a load and means to selectively disengage said frictionally engageable members with a sufficient force to overcome the force of the film web against the downstream and upstream rollers pulling the rollers toward each other and force the downstream and upstream rollers apart.

2. An apparatus for making a unitary package from a load using a single web of stretchable plastic material to form the overwrap, comprising means to support a load, a frame, a carriage moveably mounted on said frame, a film dispenser means mounted on said carriage, said film dispenser means being adapted to hold a roll of stretchable plastic material and dispense the material, means to provide relative rotation of the load and the film dispenser means to pull said material off of said dispenser means, elongation means mounted on said carriage adapted to receive stretchable plastic material from said film dispenser means and elongate said plastic material, said elongation means comprising at least two moveable roller assemblies spaced apart so that one roller assembly occupies an upstream roller position and the other roller occupies a downstream roller position, a frictionally engageable member mounted to each of said roller assemblies, said roller assemblies being driven and pulled together for engagement by the moving plastic material pulled from the dispenser means by the relative rotation of the load so that said downstream roller assembly transports the plastic material faster than said upstream roller assembly to cause the plastic material to elongate between the roller assemblies before it reaches the load, the rotation of the load causing a plurality of layers of pre-stretched material to be placed around said load to form a wrapped tensioned unitary package and cam means mounted to said roller assemblies, said cam means including a cam roller and a member defining an inclined surface on which said cam roller rides to withstand the force of the plastic material and hold separate the roller assemblies allowing substantially unstretched plastic material to be placed around said load.

3. Apparatus as claimed in claim 2, wherein said frictionally engageable members are rollers having a smooth outer circumference, each roller being secured to a rotatable shaft.

4. Apparatus as claimed in claim 3, wherein the diameter ratio of a downstream roller to an upstream roller of the frictionally engageable member ranges from 3:2 to 3:1.

5. An apparatus for making a unitary package using a single web of stretchable plastic material to form the overwrap comprising a frame, a carriage moveably mounted on said frame, a film dispenser means mounted on said carriage, said film dispenser means being adapted to hold a roll of stretchable plastic material and dispense the material, elongation means mounted on said carriage adapted to receive stretchable plastic material from said film dispenser means and elongate said plastic material, said elongation means comprising a first and second pivotal roller assemblies spaced apart so that one roller assembly occupies an upstream roller position and the other roller assembly occupies a downstream roller position, each of said roller assemblies comprising a pivotal support means, a shaft rotatably mounted in said pivotal support means, a film roller member secured to said shaft, and a circular friction member fixedly secured to said shaft, said circular friction member on each shaft being of a different diameter adapted to selectively frictionally engage the circular friction member of the other roller assembly to drive the other roller assembly so that the downstream roller transports the material faster than said upstream roller causing the material to elongate between the roller members, said friction members being pulled together for frictional engagement by the force of the material pulled from the roll of stretchable plastic material.

6. Apparatus as claimed in claim 5, wherein said support means comprises at least two planar arms connected together by a support member.

7. Apparatus as claimed in claim 5, including a cam assembly mounted to said support means, said cam assembly comprising a cam member defining an inclined surface mounted to one of said support means and a cam mechanism mounted to the other of said support means, said cam mechanism comprising a housing, a cam roller rotatably mounted to said housing and adapted to travel along said cam member's inclined surface and an extension member extending from said housing, said extension member being adapted to engage a stop means and drive said cam roller along said cam members inclined surface overcoming the force of the material on the roller assemblies to separate the friction members allowing a web of substantially unstretched film web to be pulled from said dispneser means on to said load.

8. Apparatus as claimed in claim 5, wherein each said friction member is comprised of a plurality of concentric layers of polyurethane, each of said layers of polyurethane having a different durometer with the inner layer of polyurethane being of a higher durometer than the outer layer of polyurethane.

9. Apparatus as claimed in claim 8, wherein said inner layer of polyurethane has a durometer of approximately 90 and said outer layer of polyurethane has a durometer ranging from 40 to 50.

10. Apparatus as claimed in claim 5, wherein said frictional members are removeably mounted to said shafts.

11. Apparatus as claimed in claim 10, wherein said removeably mounted friction members are mounted to said shaft by pin means, said pin means being placed through appertures defined in said shaft and said friction members holding said friction members fixedly mounted to said shaft.

12. An apparatus for making a unitary package from a load using a single web of stretchable plastic material to form the overwrap comprising a frame, a cam stop means mounted on said frame a carriage moveably mounted on said frame, a film dispenser means mounted on said carriage, said film dispenser means being adapted to hold a roll of stretchable plastic material and dispense the material, means to support a load, means to provide relative rotation of the load and the film dispenser means to pull said plastic material off of said dispenser means, elongation means mounted on said carriage adapted to receive stretchable plastic material from said film dispenser means and elongate said plastic material, said elongation means comprising two pivotable roller assemblies spaced apart so that one roller assembly occupies an upstream roller position and the other roller assembly occupies a downstream roller position, each of said roller assemblies comprising support means, a shaft rotatably mounted on said support means, a film engaging roller member mounted to said shaft and a friction drive member fixedly mounted on said shaft, said friction drive members being removeable from said shafts and adapted to be replaced with friction drive members of varying diameters to achieve a ratio between friction members of the downstream positioned roller assembly and upstream positioned roller assembly of 3:2 to 3:1, said roller assemblies being driven and pulled together by the moving plastic material pulled from the dispenser means by the rotation of the load causing engagement of the friction drive members so that the downstream roller assembly transports the plastic material faster than the upstream roller assembly stretching the plastic material between the roller assemblies before it reaches the load proportional to the ratio of the diameters of the friction drive members, the rotation of the load causing a plurality of layers of prestretched plastic material to be placed around said load to form a wrapped tensioned unitary package and cam means mounted to said support means, said cam means including a cam roller mechanism mounted on one of said roller assembly support means and a cam member defining an inclined surface on which said cam roller mechanism rides mounted on the support means of the other roller assembly so that at the bottom of the wrap cycle said cam roller mechanism engages said stop means to drive said cam roller mechanism along said inclined surface forcing the roller assemblies apart allowing substantially unstretched film to be placed around said load.

13. Apparatus as claimed in claim 12, wherein said cam roller mechanism comprises a housing pivotally mounted to said support means, a roller rotatably mounted in said housing, at least a portion of said roller surface extending beyond said housing, and housing driving means mounted to said housing.

14. Apparatus as claimed in claim 13, wherein said housing driving means comprises a tubular member secured to said roller housing, spring means mounted in said tubular member and piston means slideably mounted in said housing and connected to said spring means.

15. Apparatus as claimed in claim 14, wherein said piston means comprises a base member having a diameter less than the inside of said tubular member and a driver rod mounted to said base member, said driver rod extending out of said tubular member below said roller assemblies.

* * * * *